US006506295B1

(12) United States Patent
Takahashi et al.

(10) Patent No.: US 6,506,295 B1
(45) Date of Patent: Jan. 14, 2003

(54) CATHODIC PROTECTION METHOD AND DEVICE FOR METAL STRUCTURE

(75) Inventors: Masahiro Takahashi, Tokyo (JP); Eisuke Wada, Yokohama (JP); Yasuhiko Takahashi, Yokohama (JP)

(73) Assignee: Jonan Co., Ltd., Tokyo (JP)

( * ) Notice: Subject to any disclaimer, the term of this patent is extended or adjusted under 35 U.S.C. 154(b) by 0 days.

(21) Appl. No.: 09/857,615

(22) PCT Filed: Oct. 6, 1999

(86) PCT No.: PCT/JP99/05505

§ 371 (c)(1),
(2), (4) Date: Jun. 6, 2001

(87) PCT Pub. No.: WO01/25507

PCT Pub. Date: Apr. 12, 2001

(51) Int. Cl.[7] ..... C23F 13/00

(52) U.S. Cl. ..... 205/725; 205/726; 205/729; 205/740; 204/196.02; 204/196.06; 204/196.07; 204/196.11

(58) Field of Search ..... 205/724, 725, 205/726, 729, 740; 204/196.02, 196.06, 196.07, 196.11

(56) References Cited

U.S. PATENT DOCUMENTS 4,036,716 A 7/1977 Hulthe
5,954,938 A * 9/1999 Takahashi et al. ..... 205/724
6,046,515 A * 4/2000 Lewis ..... 205/729
6,224,742 B1 * 5/2001 Doniguian ..... 205/740
6,331,243 B1 * 12/2001 Lewis ..... 205/740

FOREIGN PATENT DOCUMENTS

| | | |
|---|---|---|
| GB | 1 522 716 | 8/1978 |
| JP | 04-318183 | 11/1992 |
| JP | 10-237681 A | 9/1998 |
| JP | 11-043788 A | 2/1999 |
| JP | 11-286793 | 10/1999 |

* cited by examiner

*Primary Examiner*—Bruce F. Bell
(74) *Attorney, Agent, or Firm*—Workman, Nydegger & Seeley

(57) ABSTRACT

A main anode and a pilot anode are mounted on a coating film of a metal structure, a cathode is mounted on a metal based material of the metal structure, a predetermined voltage is applied from the pilot anode to the metal structure, a magnitude of corrosion protection current of the metal structure is read from a current value of the pilot anode varying with variation of corrosion environment of the metal structure, the application voltage of the main anode is increased or decreased in accordance with the current value, whereby providing a cathodic protection method and apparatus for a metal structure capable of expanding protectable area by a single anode to a maximum without causing over-corrosion protection.

20 Claims, 14 Drawing Sheets

CATHODIC PROTECTION METHOD AND DEVICE FOR METAL STRUCTURE

FIELD OF THE INVENTION

The present invention relates to a cathodic protection method and apparatus for protecting a metal structure exposed in the atmosphere such as exterior wall of a building, roof, and bridge from being corroded by oxidation, and to as an application thereof, a cathodic protection method and apparatus of a steel member contacted with water in water piping or tanks.

DESCRIPTION OF BACKGROUND ART

A metal structure exposed in the atmosphere, even when its metal surface is painted, with the passage of time, is oxidation corroded by electrolytic water and dissolved oxygen in that water formed on the surface by rain water or moisture in the air or pollution substances in the atmosphere or the like.

As protective anode and cathodic protection system for performing corrosion protection of the coated surface of such a metal structure, there is an apparatus developed and commercialized by C. L. I. Systems Inc. (U.S.A.) (U.S. Pat. No. 2,579,259 (Japanese Patent Laid-open Publication No. 4-318183).

This electrical corrosion protection apparatus has an effect for corrosion protection of a metal structure having a surface protected by surface coating which is exposed in the atmosphere, however, has the following two unavoidable problems. These problems are (1) Current control means as a subject matter has a function to apply a current proportional to the environmental humidity detected by a humidity sensitive device. However, in practice, depending on the amount of sea salt particles or atmospheric pollution substances dissolved in the water film, even with the same humidity and the same thickness of the water film, it is evident that electrical resistance per unit length of the water film itself is greatly varied. Therefore, since the current necessary for corrosion protection is changed with the quality of the water film, even when the same magnitude of current is applied, reaching range of corrosion protection current is changed according to the environmental water quality at that time.

Further, the surface coating film of the metal structure is partly degraded by sand dust or other environmental affecting factors, generating a defect in part thereof. If this defective part expands, even with the same environmental humidity, the current amount necessary for extensive surface corrosion protection of the metal structure containing the defective part is greatly increased. For example, assuming a case where a large amount of sea salt particle is dissolved in the water film and the defect of the coating film is generated around the protective anode of the apparatus, at a humidity of 60 to 70% and a low temperature, and if only a small amount of current is supplied, since the supplied current flows into the above-described defective part, the current is consumed in a small area in the vicinity of the protective anode, thus reducing the reaching range of the corrosion protection current.

(2) To prevent over-corrosion protection of the metal structure in the vicinity of the protective anode, the anode output voltage is set to a maximum of 12V. However, as described above, when the area of the defective part of coating film is increased, to achieve the desired corrosion protection range, it is necessary to further increase the voltage to increase the current. For this requirement, current application by a maximum output voltage of 12V cannot meet.

With the above prior art circumstances, it is therefore an object of the present invention to provide a cathodic protection method and apparatus for a metal structure in which the area of corrosion protection obtainable by a single anode can be increased to a maximum without causing over-corrosion protection.

DISCLOSURE OF THE INVENTION

With the aim of solving the above problems, the inventors have conducted the following experiments and investigations and accomplished the present invention.

In the experiments, various systems have been constructed, trial and error has been repeated to confirm whether or not the desired function can be achieved, and initially the system as shown in FIG. 1 has been completed.

In the figure, numeral 1 indicates a terminal of a 100 to 200V power supply, 2 is a fuse, 3 is a surge current absorption varistor. 4 is a transformer which steps the output down to 18 to 20V. Further, 5 is a rectifier circuit which converts AC to DC. 6 and 7 are capacitors. 8 is a regulator which controls the voltage applied to a main anode 15. 9 and 10 are capacitors, and 21 is also a capacitor. 22 is a regulator which controls the voltage applied to a pilot anode 20 to a constant value. 23 and 24 are capacitors.

The above-described power supply terminal 1 to capacitor 10, capacitor 21, regulator 22, and capacitors 23 and 24 are incorporated in a controller 30.

A transistor 11, resistors 12 and 14, and a Zener diode 13 constitute a first current limitation means 100 for limiting the current supplied to the main anode 15 to a predetermined value. Further, a capacitor 25, an operational amplifier 26, resistors 27, 28 and 29 constitute a second current limitation means 101 which detects the current from the pilot anode 20 to a coated steel plate (metal structure) 16 to be corrosion protected, and according to the detected current value, controls the output voltage of the regulator 8 through the ground of the regulator 8, whereby flowing a predetermined optimum current from the main anode 15 to the coated steel plate 16. Between the main anode 15 and the coated steel plate 16, a special medium 70 having an electrical resistance is disposed.

The first current limitation means 100 is integrated with the main anode 15, and the second current limitation means 101 is integrated with the pilot anode 20. In the figure, numeral 17 indicates a coating film provided on the coated steel plate 16 to be corrosion protected. 18 is a defective part of the coating film 17, and 19 denotes a water film formed on the surface of the coated steel plate 16.

In the apparatus of the above construction, when the output voltage of the regulator 22 is a constant value of 8V to 12V, and the current is increased by an increase in electrical conductivity of the water film 19 and expansion of the defective part 18, accordingly the output voltage of the regulator 8 is increased from 10V to, for example, 15V to supply the desired optimum corrosion protection current to the coated steel plate 16.

FIG. 2 shows an outline of a test apparatus for confirming the corrosion protection function of the protection apparatus of the construction shown in FIG. 1. The main anode 15 and the pilot anode 20 are stuck to the coated steel plate 16 through an insulating two-sided bonding material. Anode wires 30*a* from the controller 30 are connected to the corresponding main anode 15 and pilot anode 20, and further, a cathode wire 30*b* connected to a base material 32 of the coated steel plate 17.

Part of the coating film at a position away from the anode connection position of the coated steel plate 16 is peeled out to form an artificial coating film defective part 18 of 10 mm in diameter. The coating film defective part 18 is provided with an Ag/AgCl microelectrode (ϕ=0.1 mm) 31 coated with agar agar containing saturated KCl. Potential of the steel plate base material 17 to the electrode 31 is outputted to a computer through a buffer to collect data.

The controller 30 is connected with AC 100V power supply, after confirming that the voltage of the pilot anode 20 is constant at the setting value 10V, the coated steel plate 16 is subjected to an exposure test for about 30 days. As a result, in the state of a humidity of less than 60%, the voltage applied to the main anode 15 exhibits the minimum value 10V, the potential increases with increasing humidity, reaching about 13V in rainfall.

Further, in addition to the above-described position, a coating film defective parts are also formed between the coating film defective part of the above position and the respective anodes of the main anode 15 and the pilot anode 20, so that the voltage applied to the main anode 15 in rainfall is the maximum of 15V.

In this state, the potential of the coating film defective part 18 shows a value of about −850 mV, showing that a sufficient corrosion protection is achieved.

Further, no sign of over-corrosion protection is noted in the coating film 17 in the vicinity of the main anode 15, and since the current flowing from the main anode 15 to the defective part 18 of the coating film 17 is sufficiently high, it can be conjectured that the voltage in the coating film in the vicinity of the main anode 15 is lower than the voltage of generating over-corrosion protection by a voltage drop in the water film on the surface of the insulating bonding material (special medium) 70 in the lower part of the main anode 15.

That is, when the required corrosion protection current is increased by increasing other coating film defective parts between the coating film defective part 18 at a position away by 2.5 to 3.0 m from the main anode 15 and the main anode 15, in the prior art, the main anode voltage 12V becomes a limit, and the potential of the coating film defective part 18 is not decreased to the corrosion protection potential, on the other hand, in the method and apparatus according to the present invention, the voltage is increased with increasing required current value, and therefore, it is confirmed that even if coating film defective parts are substantially increased, the potential of the farthest defective part 18 is sufficiently decreased to attain the corrosion protection potential. From this fact, a new technology superior in corrosion protection capability to the prior art has been established by the present invention.

As a most economical method for performing corrosion protection of a metal structure by a combination of a coating film formation paint and a cathodic protection method, a test as shown in FIG. 2 has been carried out using an apparatus of the cathodic protection method by the present invention, in which a metal structure (coated steel plate) is coated with a general-purpose insulating paint as an underlayer, and a paint of low electrical resistance is provided as a top layer.

Using a paint having a resistance of 0.2 Ωcm as a top layer paint, an artificial defective part of coating film is provided at a position 5 m away from the main anode 15, the controller 30 is energized, water is sprayed on the surface of the coating steel plate 16, and the potential of the coating film defective part 18 is measured.

The potential shows a value of −850 to −950 mV, which is within the passivation area, and shows that corrosion protection is sufficiently achieved.

Next, as a most economical method for performing corrosion protection of a metal structure by a combination of the coating film formation paint and a cathodic protection method, to further enhance the function of the above-described method, the following method has been tested. As the coating of the metal structure, the underlayer uses a general-purpose insulating paint, the intermediate layer uses a conductive paint, and the top layer uses a paint having a good weather resistance. First, on the underlayer coating film coated on the surface of the metal structure, a thin-plate anode is stuck with an insulating tape, on top thereof, the above intermediate layer conductive paint and the top layer paint of superior weather resistance are coated, and the test similar to the above is carried out.

As the conductive paints, using a carbon-based type material having a volume resistivity of 0.9 Ω·cm and a nickel-based type material having a volume resistivity of 0.0025 Ω·cm, an artificial defective part of coating film is provided at a position 10 m away from the main anode 15, a voltage is applied, water is sprayed on the artificial defective part and the potential of the defective part is measured.

The potential shows about −850 mV for the carbon-based type material, and in the case of the nickel-based type material, even when the anode voltage is further decreased to 1 to 2V, a value of −900 to −1100 mV is shown, which is within the passivation area, obviously showing that sufficient corrosion protection is achieved.

In a color steel plate using an ordinary insulating paint, corrosion protection potential of the artificial defective part is reached only to about 2.5 to 3.5 m away from the main anode, whereas by the optimum combination of the paint and cathodic protection, a technology capable of remarkably increasing the corrosion protection range can be established.

When considering a vehicle such as an automobile as the metal structure, for cathodic protection for a vehicle, there is a product developed and commercialized also in Japan (U.S. Pat. No. 2,579,259) by C. L. I. Systems Inc. (U.S.A.).

This electrical corrosion protection apparatus provides an effect of corrosion protection of metal parts of a vehicle, in which the anode voltage is 12V by the limitation of the battery voltage. Therefore, to further enhance the corrosion protection ability, it is necessary to increase the voltage, for example, in the results of comparative test of the potential of coating film defective part at a position 1.5 m away from the anode shown in FIG. 3, for the case of the anode voltage of 15V, the potential falls within the corrosion protection area at a relative humidity of higher than 61%, whereas for the case of 12V, corrosion protection area is not achieved unless the relative humidity is more than 66%.

On the other hand, the inventors, as a system for performing electrical corrosion protection of a vehicle body, by an electronic circuit shown in FIG. 4, in which voltage from a 12V battery power supply is increased to 15V by a DC/DC converter and applied to the anode through a low current mechanism. In FIG. 4, a battery indicated by numeral 201 is used as a power supply, 12V voltage is applied to the system. 202 includes a battery protection circuit and an IC protection circuit. 204 is a DC/DC converter, which steps up and controls the output voltage, for example, to 20V. 205 is an overvoltage prevention system, which serves to decrease the voltage when the voltage is unusually increased over the above controlled value. Further, by a system comprising a transistor 207, a resistor 208 and a Zener diode, as an example, the voltage is controlled to a constant voltage of 15V and supplied from constant current systems 213A to 213D. 15V voltage is applied from the constant current systems 213A to 213D to anodes 214A to 214D through wiring. Up to the circuit elements 202 to 213 are incorporated in a single case as one unit as a whole. The anodes 214A to 214D are adhered onto the coated surface under the vehicle, thereby protecting the iron structure inside the coating film by the cathodic protection method.

As an example of this system, an improved system for suppressing current consumption, accomplished through trial and error, is shown in FIG. 5 to FIG. 7.

In FIGS. 5 to 7, using the battery 201 as the power supply, 12V voltage is applied to the system. Numeral 202 includes a battery protection circuit and an IC protection circuit. An 8-pin IC 217 has an oscillation function, converts DC into pulses, the voltage is increased by a voltage converter 229, and controlled at 20V by a FET 228. The system comprising the resistor 215 and the Zener diode 216 supplies power for operating the 8-pin IC 217. The voltage is regulated by a system comprising the capacitors 232, 234, 235 and the diode 233 and supplied to the transistor 207. Resistor containing transistors 223 and 225 serves an overvoltage prevention function. By the system comprising the transistor 207, the resistor 208 and the Zener diode 209, the voltage is regulated, for example, to a constant voltage of 15V, which is supplied to the constant current systems 213A to 213D. From the constant current systems 213A to 213D to the anodes 214A to 214D through wiring, a voltage of, for example, 15V is applied. Elements from the battery and the IC protection circuit 202 to the constant current systems 213A to 213D are incorporated in a single case as a control unit. The anodes 214A to 214D are adhered to the coated surface under the vehicle, thereby protecting the iron structure inside the coating film by the cathodic protection method.

Using the system of the above construction, a corrosion protection system for vehicle with minimized current loss is obtained in which the battery voltage is stepped up by an IC system without using a transformer.

In FIGS. 4 and 5, symbols 203, 206, 210, 218, 219, 220, 232, 235, and 238 are capacitors. Further, symbols, 208, 212, 215, 221, 222, 224, 226, 227, 230, 231, 236, 237, and 240 are resistors. Still further, 209, 216, and 239 are Zener diodes. Yet further, 236 is a FET, 223 and 235 are resistor containing transistors, and 229 is a voltage converter.

Further, details of a circuit 500 in FIG. 5 are shown in FIG. 6. In FIG. 6, symbols 241, 242, 246, 247, 248, 249, and 250 are resistors, 243 is a capacitor, 244 is a transistor, and 245 is an operational amplifier.

Still further, details of the constant voltage systems 213A to 213D are shown in FIG. 7. In FIG. 7, 252 and 254 are resistors, 251 is a transistor, and 253 denotes a Zener diode.

As the metal structure subjected to the method of the present invention, metal structures such as buildings and bridges, vehicles such as automobiles, metal pipings which will be described later, metal washing tanks for washing foods such as vegetables are included, the method of the present invention can be applied to all types of structures if those are required to be corrosion protected.

As can be seen from the above description, the cathodic protection method for a metal structure according to one embodiment of the present invention is a cathodic protection method of flowing a current from an external power supply to the metal structure to protect the metal structure from corrosion characterized in that a main anode and a pilot anode are mounted on a coating film of the metal structure, a cathode is mounted to a metal base material of the metal structure, a predetermined voltage is applied from the pilot anode to the metal structure, a magnitude of corrosion protection current of the metal structure to be corrosion protected is read from a current value of the pilot anode varying with variation of corrosion environment of the metal structure, the application voltage of the main anode is increased or decreased in accordance with the current value, whereby supplying an optimum corrosion protection current according to corrosion environment of the metal structure.

The cathodic protection method for a metal structure according to another embodiment of the present invention is wherein the pilot anode and the main anode are not only one to one correspondence, but also one pilot anode corresponds to a plurality of main anodes.

The cathodic protection method for a metal structure according to another embodiment of the present invention is wherein the pilot anode and the main anode are mounted to the metal structure to be corrosion protected through an insulating two-sided bonding material, whereby a water film is formed continuously from the surface of the metal structure to the respective anode, so that when a corrosion condition of the metal structure is met, a current optimum for corrosion protection flows between the anode and the cathode connected to the metal base material of the metal structure.

Further, the cathodic protection apparatus for a metal structure according to another embodiment of the present invention is a cathodic protection apparatus of flowing a current from an external power supply to the metal structure to protect the metal structure from corrosion characterized by comprising a main anode and a pilot anode mounted on a coating film of the metal structure, a cathode connected to a metal base material of the metal structure, a predetermined voltage is applied from the pilot anode to the metal structure, current control means for applying a predetermined voltage from the pilot anode to the metal structure, reading a magnitude of corrosion protection current of the metal structure to be corrosion protected from a current value of the pilot anode varying with variation of corrosion environment of the metal structure, increasing or decreasing the application voltage of the main anode in accordance with the current value, whereby supplying an optimum corrosion protection current according to corrosion environment of the metal structure.

The cathodic protection apparatus according to claim 5 of the present invention is wherein the main anode and the pilot anode are not only one to one correspondence, but one pilot anode corresponds to a plurality of main anodes.

The cathodic protection apparatus according to another embodiment of the present invention is further comprising an insulating two-sided bonding material for mounting the pilot anode and the main anode on the surface of the metal structure, by mounting the respective anodes to the metal structure to be corrosion protected through the insulating two-sided bonding material, whereby a water film is formed continuously from the surface of the metal structure to the respective anode, so that when a corrosion condition of the metal structure is met, a current optimum for corrosion protection flows between the anode and the cathode connected to the metal base material of the metal structure.

The cathodic protection apparatus according to another embodiment of the present invention is wherein functions of the pilot anode and the main anode are integrally provided.

The cathodic protection apparatus according to another embodiment of the present invention is wherein the current control means comprises transistors, diodes, operational amplifiers, resistors, and other electronic components.

Further, the cathodic protection method for a metal structure according to another embodiment of the present invention is wherein the metal structure is a vehicle, and as a voltage application source, a combination of a battery incorporated in the vehicle with electronic components for increasing the voltage of the battery is used.

Further, the cathodic protection apparatus according to another embodiment of the present invention is wherein the metal structure is a vehicle, and as a voltage application source, a combination of a battery incorporated in the vehicle with electronic components for increasing the voltage of the battery is used.

Yet further, the cathodic protection method for a metal structure according to another embodiment is characterized in that a coating of a metal structure to be corrosion protected is performed by a combination of an underlayer of an ordinary insulating paint and a top layer of a conductive paint, and to the coated metal structure.

Yet further, the cathodic protection method for a metal structure according to another embodiment is characterized in that a coating of a metal structure to be corrosion protected is performed by a combination of an ordinary insulating paint as an underlayer, a weather resistant paint as a top layer, and a conductive paint as an intermediate layer, and to the coated metal structure.

Yet further, the cathodic protection method for a metal structure according to another embodiment of the present invention is a cathodic protection method of flowing a current from an external power supply to the metal structure to protect the metal structure from corrosion characterized in that the metal structure is a water pipe, an anode is mounted to inside of the water pipe, a cathode is mounted to a metal base material of the water pipe, and a voltage is applied between the anode and the cathode, thereby flowing a predetermined current in the water pipe.

The cathodic protection method for a metal structure according to another embodiment of the present invention is wherein polarity of the anode and the cathode is reversed with the passage of time, thereby dissolving a film formed on the surface of the electrode with the passage of time.

Further, the cathodic protection apparatus for a metal structure according to another embodiment of the present invention is a cathodic protection apparatus of flowing a current from an external power supply to the metal structure to protect the metal structure from corrosion characterized by comprising an anode mounted to the inside of a water pipe as the metal structure, a cathode mounted to a metal base material of the water pipe, and current control means for applying a voltage between the anode and the cathode, thereby flowing a predetermined current in the water pipe.

The cathodic protection apparatus for a metal structure according to another embodiment of the present invention is wherein the current control means has a function to reverse polarity of the anode and the cathode with the passage of time to dissolve a film formed on the surface of the electrode with the passage of time.

Further, the cathodic protection method for a metal structure according to another embodiment of the present invention is a cathodic protection method of flowing a current from an external power supply to the metal structure to protect the metal structure from corrosion characterized in that the metal structure is a metal tank, an anode is mounted to the inside of the metal tank and a cathode is mounted to a metal base material of the metal tank, a voltage is applied between the anode and the cathode, thereby flowing a predetermined current in the metal tank.

The cathodic protection method for a metal structure according to another embodiment of the present invention is wherein polarity of the anode and the cathode is reversed with the passage of time, thereby dissolving a film formed on the surface of the electrode with the passage of time.

Further, the cathodic protection apparatus for a metal structure according to another embodiment of the present invention is a cathodic protection apparatus of flowing a current from an external power supply to the metal structure to protect the metal structure from corrosion characterized by comprising an anode mounted to the inside of a metal tank as the metal structure, a cathode mounted to a metal base material of the metal tank, and current control means for applying a voltage between the anode and the cathode, thereby flowing a predetermined current in the metal tank.

The cathodic protection apparatus for a metal structure according to another embodiment of the present invention is wherein the current control means has a function to reverse polarity of the anode and the cathode with the passage of time to dissolve a film formed on the surface of the electrode with the passage of time.

BEST MODE FOR PRACTICING THE INVENTION

In the following, embodiments of the present invention will be described, however, the present invention is not limited to these embodiments.

(Embodiment 1)

Figure 1:
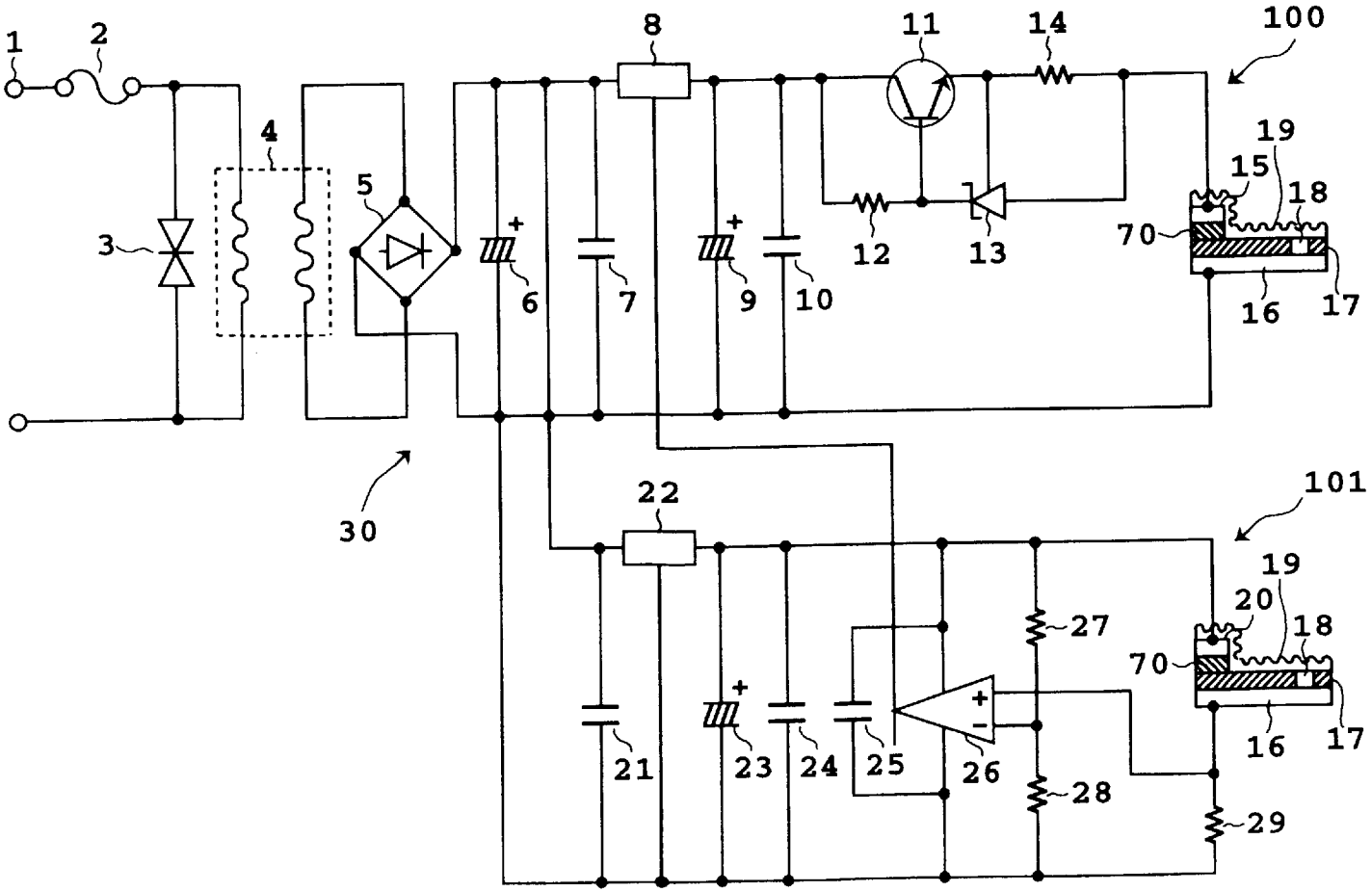
FIG. 1 is a circuit diagram of an example of cathodic protection apparatus for a metal structure according to the present invention.
Figure 2:
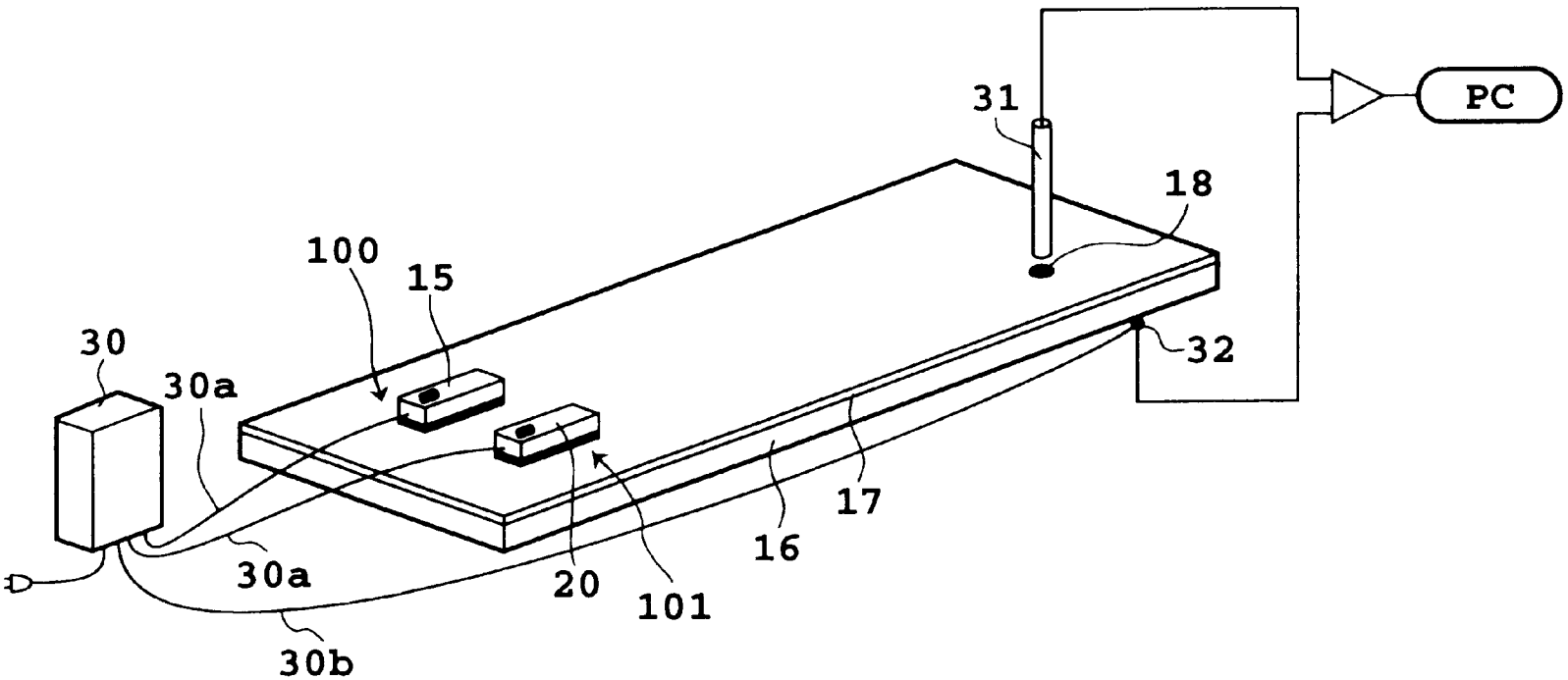
FIG. 2 is a diagram for explaining a system for measuring the function of the apparatus shown in FIG. 1.
Figure 3:
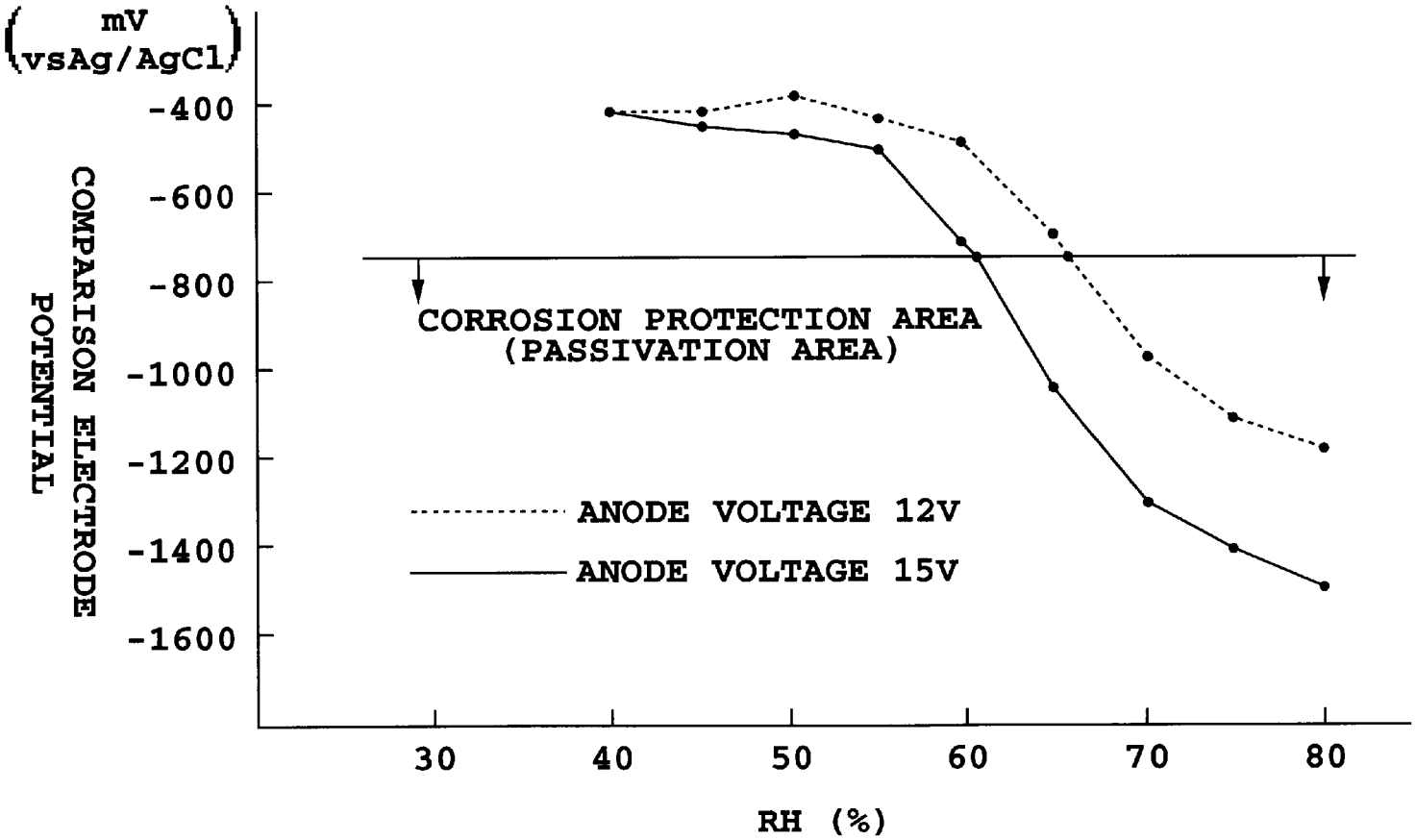
FIG. 3 is a graph showing the relationship between a relative humidity and a potential of coating defective part when the metal structure is a vehicle.
Figure 4:
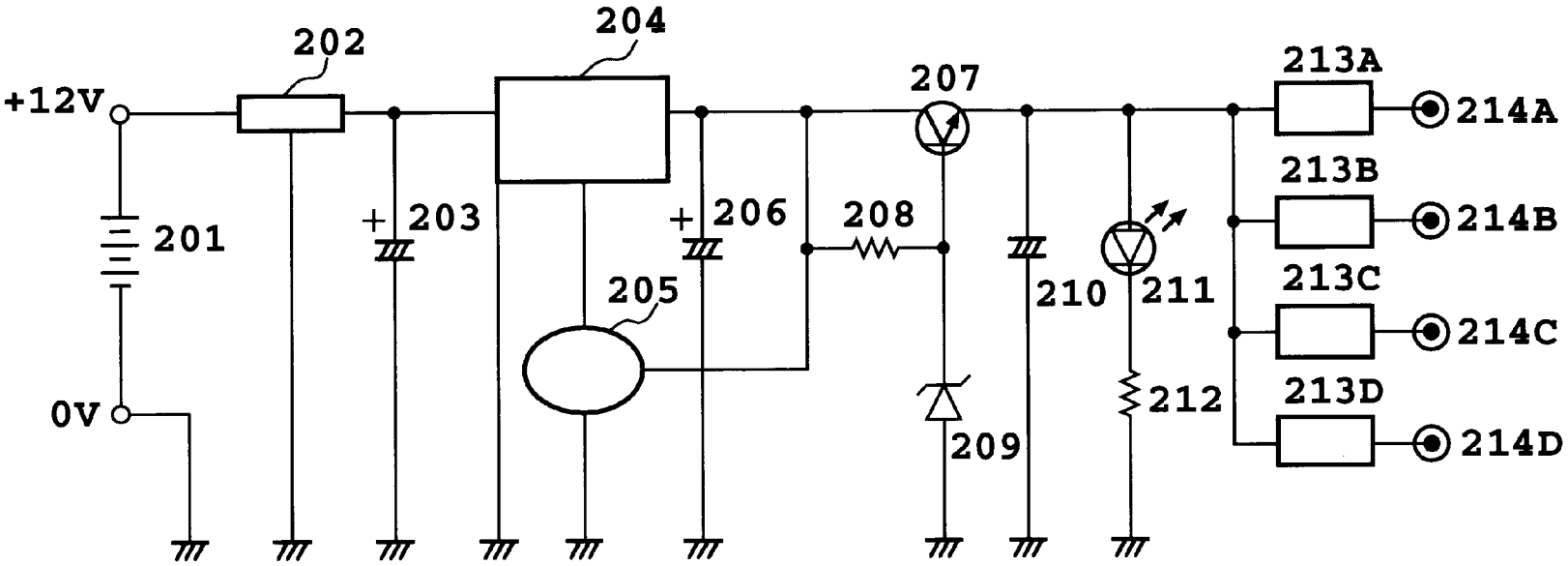
FIG. 4 is a diagram showing a basic circuit construction for controlling an applied voltage when the present corrosion protection apparatus is applied to a vehicle as the metal structure.
Figure 5:
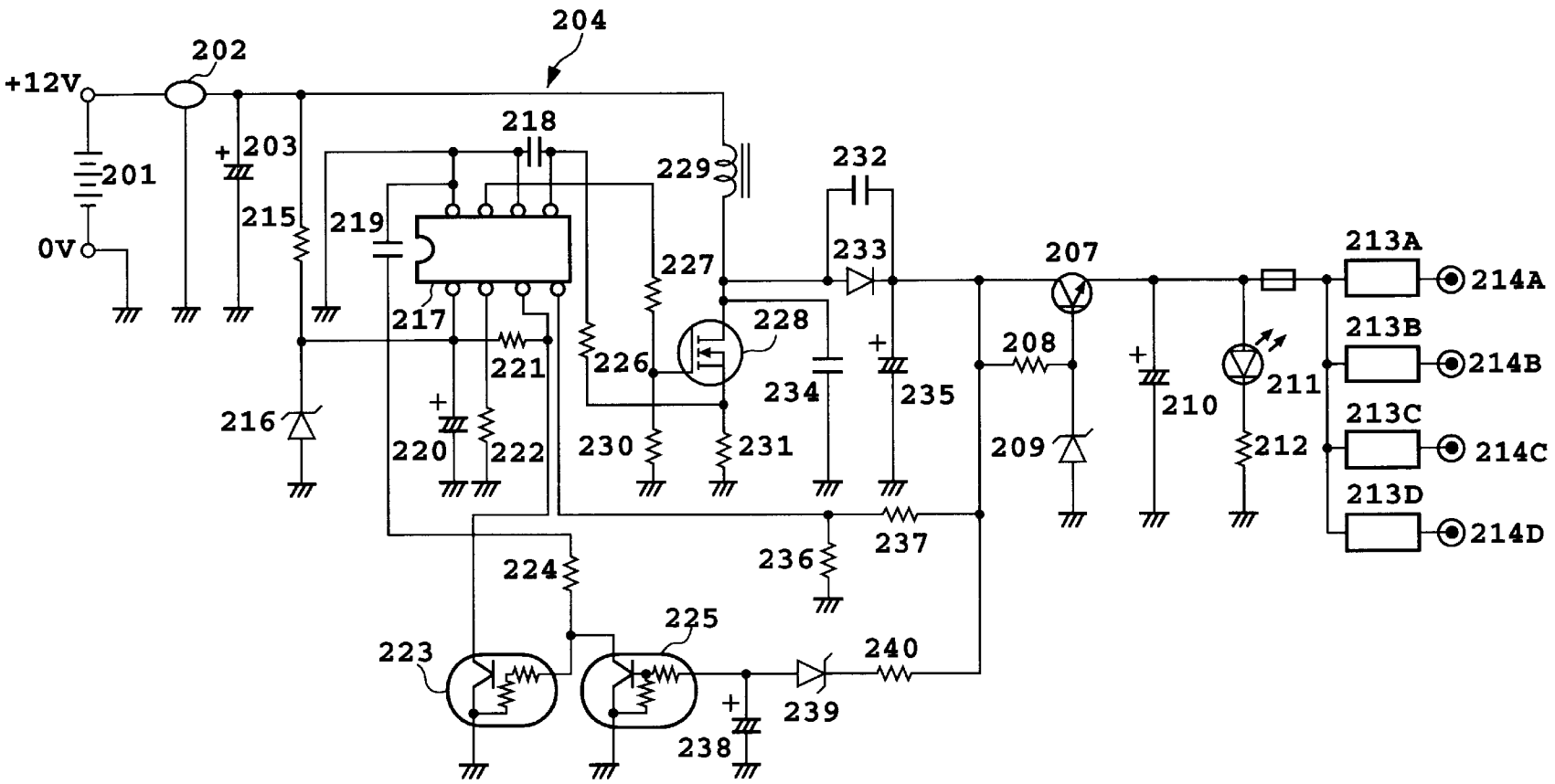
FIG. 5 is a diagram showing a practical example of the basic circuit of FIG. 4.
Figure 6:
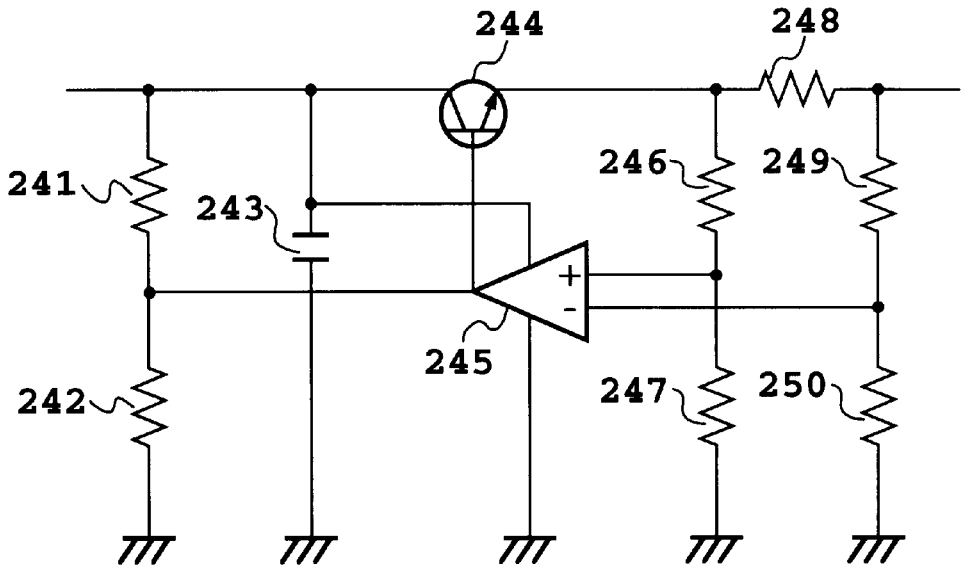
FIG. 6 is a diagram showing a detailed circuit construction of part of circuit of FIG. 5.
Figure 7:
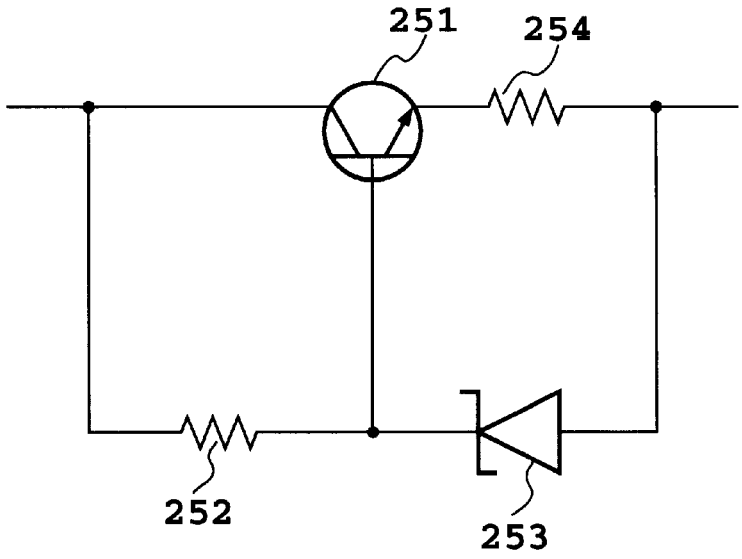
FIG. 7 is a diagram showing a detailed circuit construction of a further part of circuit of FIG. 5.
Figure 8:
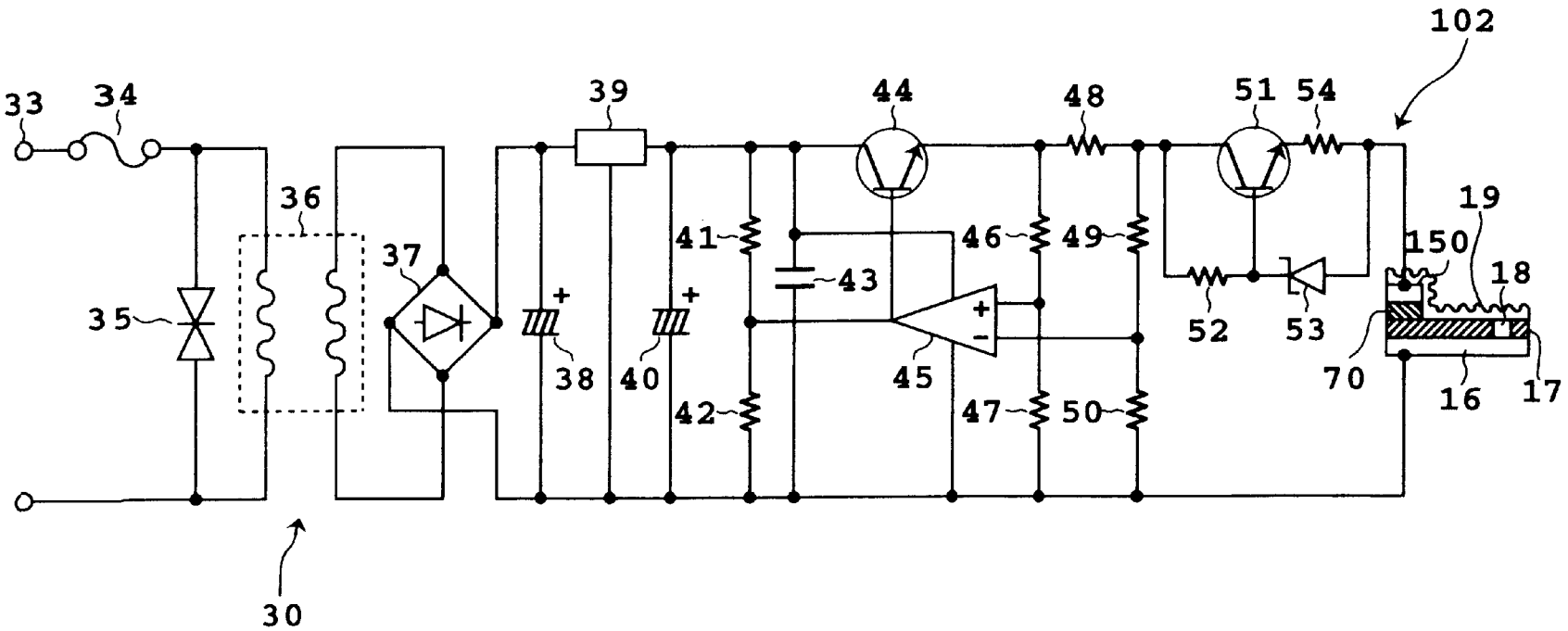
FIG. 8 is a circuit diagram of another example of the cathodic protection apparatus for a metal structure according to the present invention.

FIG. 8 is a circuit diagram of an apparatus suitable for achieving the cathodic protection method for a metal structure according to the present invention.

In the present method, a defective part 18 is in a coating film 17 of a coated steel plate 16 to be corrosion protected, and an anode 150 of such as made of aluminum or the like is bonded to the coated surface with an insulating two-sided bonding material 70. When the humidity is about 60%, a water film 19 covers the coated steel material 16, in which atmospheric pollution substances and sea salt particles dissolve to cause water constituting the water film to become an aqueous electrolyte solution, thus establishing a condition to generate a rust in the coating film defective part 18. To this condition, from a controller and the anode 150 according to the present invention, an optimum protection current is supplied to the coating film defective part 18 through the water film 19, thereby preventing rust generation in the coating film defective part 18.

As shown in the figure, electricity is introduced from a terminal 33 of an AC100 to 200V power supply, which is voltage decreased to AC18 to 20V through a fuse 34, a surge current absorption varistor 35, and a transformer 36, and a DC is produced by a rectifier circuit 37. Voltage variation is absorbed by a capacitor 38, and DC17V is supplied by a regulator 39. Then, DC17V is stabilized by a capacitor 40.

A voltage drop of a resistor 48 varying with the magnitude of the current flowing from the defective part 18 of the coating film 17 to the coated steel plate 16 from the anode 150 through the water film 19 is detected by an operational amplifier 45, and according to the detected value, voltage of the current flowing from emitter of a transistor 44 is controlled. Resistors 41, 42, 46, 47, 49, and 50 and a capacitor 43 assist stable operation of the system. A transistor 51, a Zener diode 53, resistors 52 and 54 constitute current control means 102 for preventing the current flowing from the anode 150 from exceeding a predetermined value.

The power supply terminal 33, fuse 34, varistor 35, transformer 36, rectifier circuit 37, capacitor 38, regulator 39 and capacitor 40 are incorporated in a single controller 30. Further, the resistors 41 and 42, capacitor 43, transistor 44, operational amplifier 45, resistors 46, 47, 48, 49, and 50, resistor 52, Zener diode 53 and resistor 54 are integrally incorporated in the anode 150. The single controller 30 supplies a current of a constant voltage to a single or a plurality of anode systems.

Figure 9:
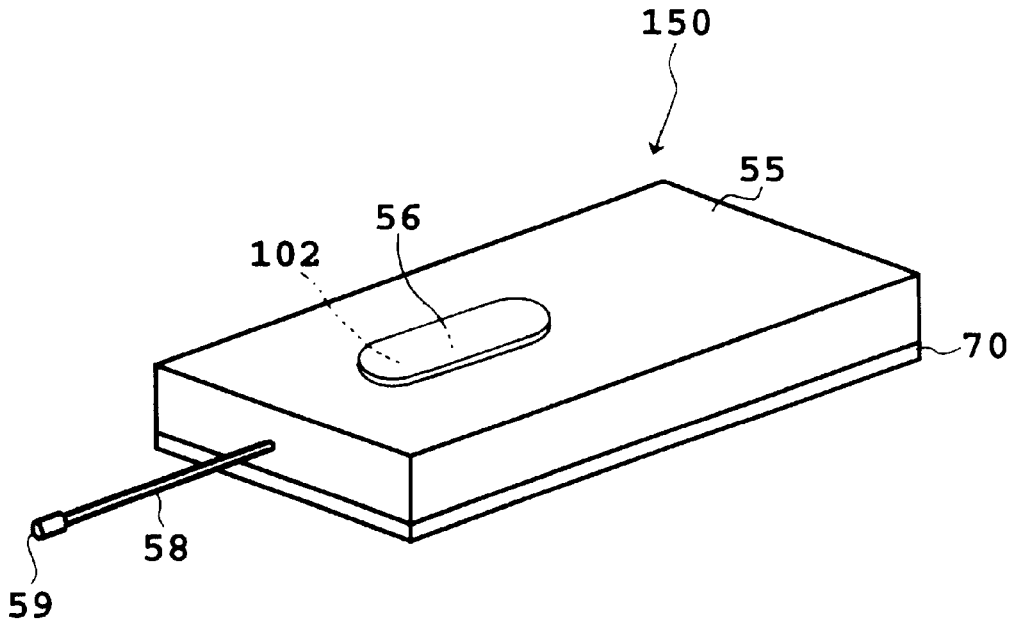
FIG. 9 is a perspective diagram showing an example of cathode of the apparatus shown in FIG. 8.

FIG. 9 shows an example of the anode 150.

In the figure, numeral 55 denotes a plate-formed aluminum anode, and in a recess 56 opening on the top surface thereof, the current control means 102 including the transistor, operational amplifier, Zener diode, resistors and the like is inserted, and the part is solidified with a hard epoxy resin.

The current control means 102 is connected with a lead wire 58 from the outside. 59 is a crimp-connection terminal for connecting an anode wiring from the controller 30. The anode 55 is stuck to the coating film 17 of the coated steel plate 16 using a two-sided bonding material 70.

(Embodiment 2)

Figure 10:
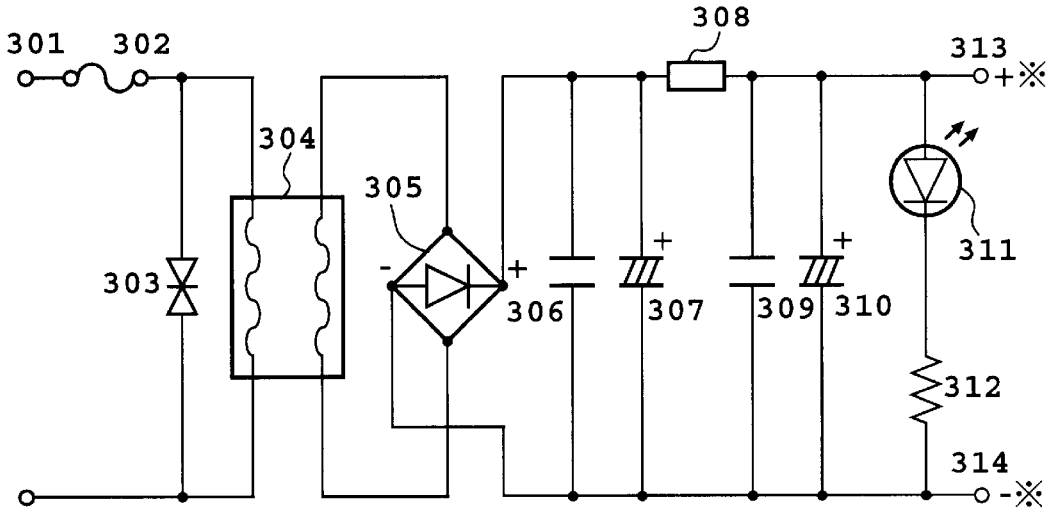
FIG. 10 is a diagram showing the construction of a voltage application control circuit when the present invention is applied to a water pipe.
Figure 11:
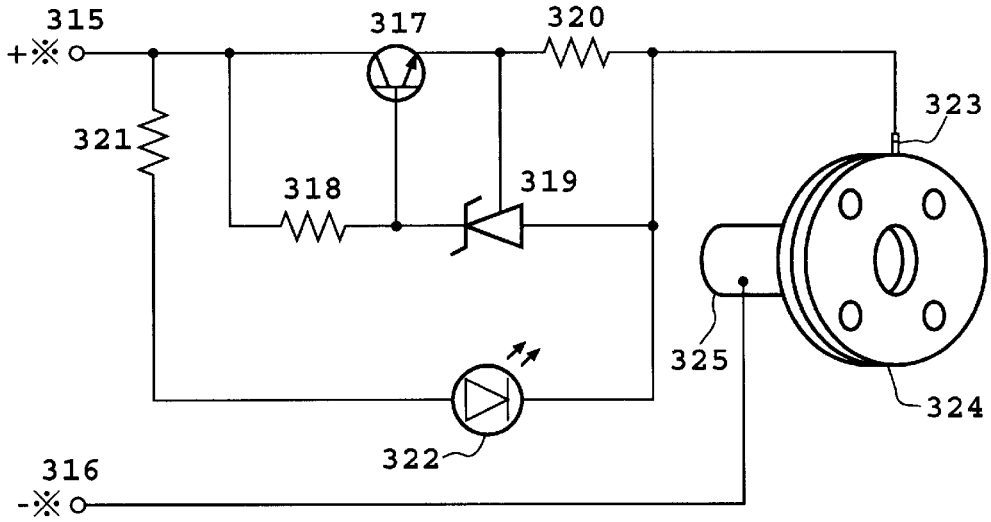
FIG. 11 is a diagram showing the construction of a voltage application control circuit when the present invention is applied to a water pipe along with FIG. 10.

The present embodiment is directed to a metal-made water pipe as the metal structure. In this apparatus, as shown in FIG. 10 and FIG. 11, a cathode 325 is mounted to an outer wall of the metal water pipe, an anode 324 is mounted to a flange disposed halfway the water pipe through a terminal 323, and a voltage applied between these parts is controlled by an electronic circuit which will be described later.

In this apparatus, output from an AC power supply 301 through a fuse 302 is stepped down by a transformer 304 to 15 to 40V. In the figure, 303 is a surge current absorption varistor. 305 is a rectifier circuit which coverts AC to DC. 306 and 307 are capacitors. 308 is a regulator which controls the voltage applied to the transistor 317 to a constant value. 309 and 310 are capacitors. 311 is a light emitting diode which displays input of electricity. 312 is a resistor for suppressing the current in the light emitting diode to a necessary minimum. 313 and 314 are output terminals. The above electronic devices are incorporated in a sealed case as a control unit. Further, 317 to 320 from a limiter for controlling a current so as not exceeding a predetermined value. 322 is a light emitting diode which is lit to display flowing of a corrosion protection current when a condition is met that a voltage is applied to the terminal 315 and a current flows to the anode 324.

In the present apparatus by selecting the limiting current value of the limiter, when, initially, electrical resistance of the metal surface in the water pipe is low and the voltage to flow the predetermined current may be low, the limiter comprising devices 317 to 320 operates so that the voltage applied to the anode terminal 323 is decreased automatically.

As an electrocoating film grows on the inner surface of the water pipe and the electrical resistance becomes high, the limiter comprising devices 317 to 320 operates so that the voltage applied to the terminal 323 is automatically increased.

As a result that with the above-described construction, the output voltage of the regulator 308 is increased to about 50V, it is possible to increase the corrosion protection distance from the anode to about 4 times as compared with cathodic protection in the water pipe with the prior art application voltage of about 12V, thereby improving the cost-effectivity. However, on the other hand, it is necessary to consider safety to human body, and from this point of view, at present, it is set so that the voltage applied to the terminal 323 of the anode 324 is suppressed to a maximum of 20 to 30V.

In FIG. 11, numerals 315 and 316 indicate terminals, 317 is a transistor, 318 is a resistor, 319 is a Zener diode, and 320 is a resistor.

(Embodiment 3)

Figure 12:
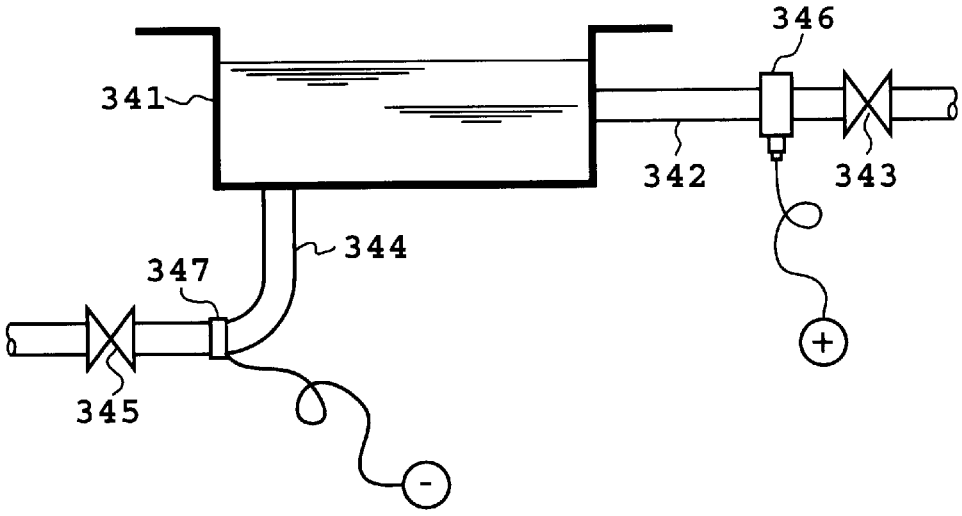
FIG. 12 is a construction diagram of an apparatus when the present invention is applied to a washing tank for foods such as vegetables.

The present embodiment is a corrosion protection apparatus directed to a washing system comprising as a metal structure, as shown in FIG. 12, a washing tank 341 for washing vegetables or the like, a water pipe (water supply pipe) 342 for supplying water to the washing tank 341, and a drain pipe (waste pipe) 344 for draining water in the washing tank 341.

The stainless steel-made washing tank 341 is connected with a water supply pipe 342 and the drain pipe 344, an anode 346 same as the anode 324 in the above cathodic protection system shown in FIG. 10 and FIG. 11 is mounted to the water supply pipe 342, and a grounding band 347 is mounted to the drain pipe 344. A valve 345 is closed and a valve 343 is opened to supply water to the washing tank 341. In this state, a voltage is applied to the anode 346 and the cathode 347 through a wiring. As a result, not only the inner surface of the washing tank 341 which is exposed to various organic substances dissolved from plants and is liable to be corroded, but also the inner surface of the water supply pipe 342 and the drain pipe 344 can be prevented from being corroded.

Further, it is found that by adopting this corrosion protection method, a secondary sterilization effect takes place not only for the washing water and drain water but also for the supply water. For this sterilization effect for water, raw vegetables of soil washed off are dipped, and in this state the protection system is operated, and the number of general bacterial in the sampling is measured. The result is shown in Table 1 below.

TABLE 1

| Time lapse from starting voltage application (min) | 5 | 10 | 15 | 20 | 30 |
|---|---|---|---|---|---|
| Number of general bacteria detected (pc/ml) | 1400 | 535 | 230 | 103 | 0 |

The reason why the time to the completion of almost perfect sterilization is as long as 30 min is presumed that a voltage drop is large in the vicinity of the anode 346, and a sufficient current does not flow to the inside of the washing tank 341 away from the anode 346. Then, to shorten the sterilization time, the following test is conducted.

(Embodiment 4)

Figure 13:
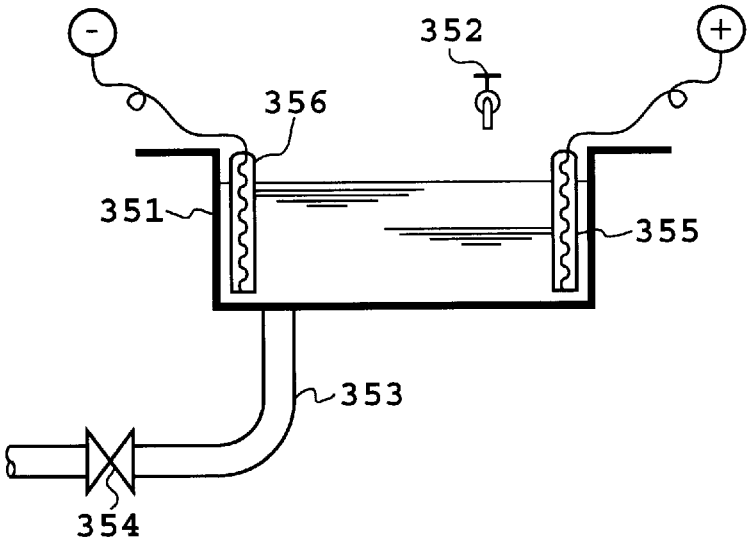
FIG. 13 is another construction diagram of apparatus when the present invention is applied to a washing tank for foods such as vegetables.
Figure 14:
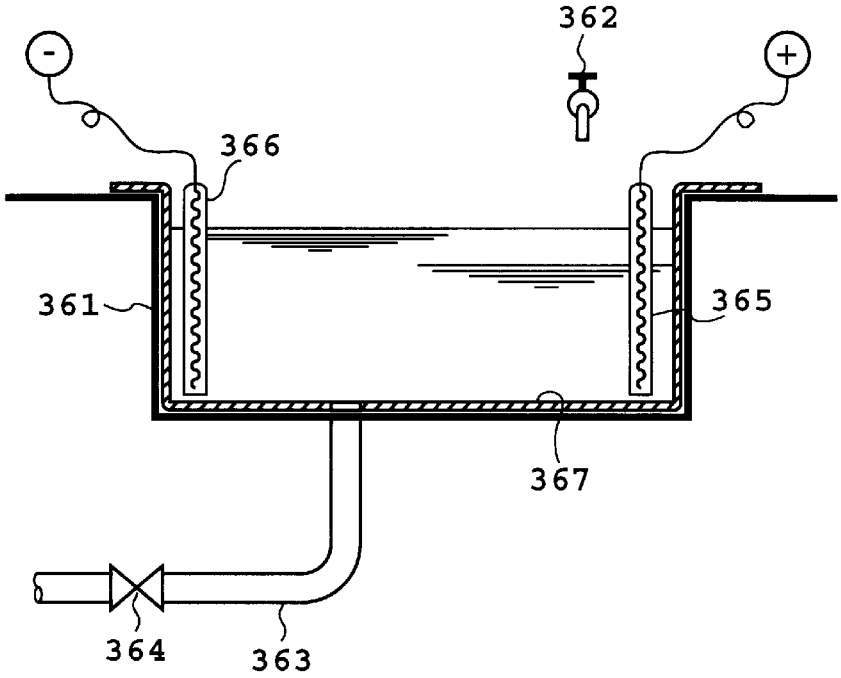
FIG. 14 is a further construction diagram of apparatus when the present invention is applied to a washing tank for foods such as vegetables.

As shown in FIG. 13, on both ends of the inside of a washing tank 351, a cylindrical anode 355 provided with a stainless steel-made mesh in a rigid polyvinyl chloride porous cylinder and a cylindrical cathode 356 are disposed, a valve 354 of a drain pipe 353 is closed, and a cock 352 of water main is opened to fill in the washing tank 351 with water. In this state raw vegetables of soil washed off are remained dipped in the washing tank 351, a voltage is applied between the electrodes to measure sterilization effect of the washing water. The result is shown in Table 2 below.

TABLE 2

| Time lapse after voltage application (min) | 3 | 6 | 10 |
|---|---|---|---|
| Number of general bacteria detected (pc/ml) | 250 | 95 | 0 |

Even in this embodiment, since a current leak to the stainless steel-made washing tank 351 is suspected. A test is conducted with further devise. The test is shown as Embodiment 5 below.

(Embodiment 5)

Inside of a washing tank 361 is lined with a polyethylene resin tank 367. A valve 364 of a drain pipe 363 is closed, and water is filled from a cock 362 in the washing tank 361. A voltage is applied between a cylindrical anode 365 and a cylindrical cathode 366 disposed on both ends in the tank, and soil washed vegetables are dipped in the tank. In this state, sterilization effect of washing water is measured. The result is shown in Table 3 below. In the present embodiment, both cases of a DC pulse voltage applied to the electrodes and an AC voltage applied are conducted, however, no substantial difference is noted between both cases.

TABLE 3

| Time lapse after voltage application (min) | 1 | 2 | 4 |
|---|---|---|---|
| Number of general bacteria detected (pc/ml) | 135 | 25 | 0 |

With the above series of embodiments, an economical method of sterilization of raw vegetables in the kitchen can be established. This sterilization effect has a further advantage of effecting at the same time of corrosion protection of the washing apparatus.

(Embodiment 6)

Figure 15:
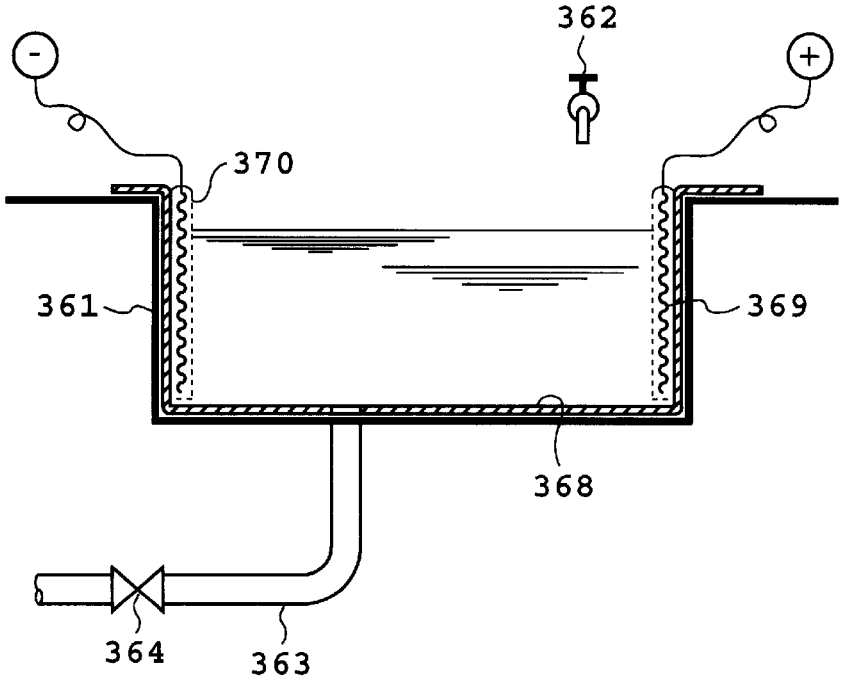
FIG. 15 is a still further construction diagram of apparatus when the present invention is applied to a washing tank for foods such as vegetables.
Figure 16:
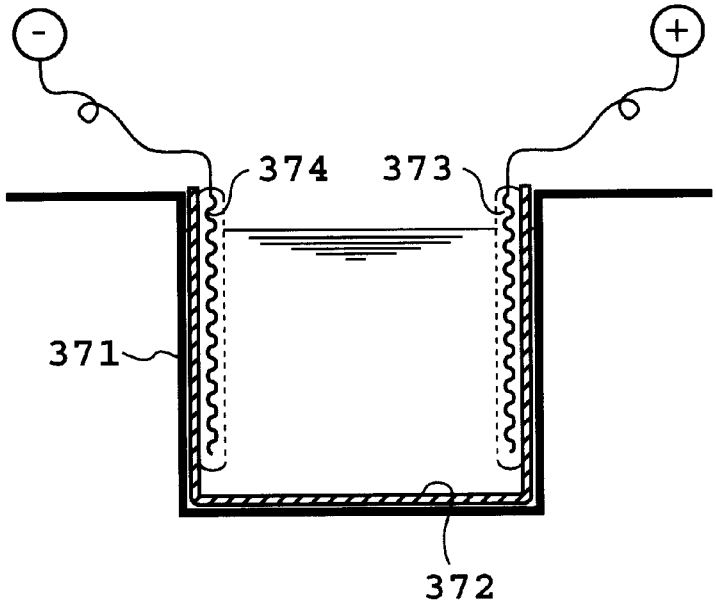
FIG. 16 is a yet further construction diagram of apparatus when the present invention is applied to a washing tank for foods such as vegetables.

As shown in FIG. 15, the cylindrical anode 365 and the cylindrical cathode 366 are integrated with a rigid synthetic resin tank 368, a stainless steel or porous plate anode 369 is inserted in a porous plastic protrusion part and a cathode 370 in a similar protrusion part at the opposite side, the anode 369 and the rigid synthetic resin layer 368 are increased in width so that current distribution in the tank is uniform. As a result, the number of general bacteria detected is decreased to 0 in 2 minutes.

(Embodiment 7)

Figure 17:
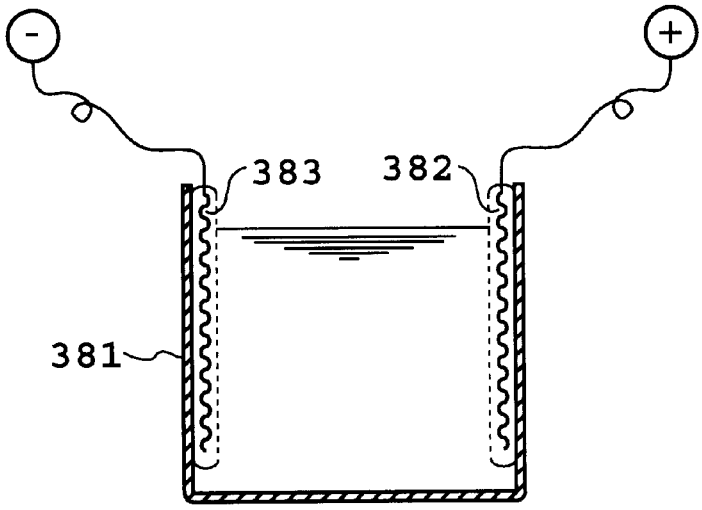
FIG. 17 is a yet further construction diagram of apparatus when the present invention is applied to a washing tank for foods such as vegetables.

As shown in FIG. 17, the present embodiment is characterized in that a synthetic resin tank 372 is placed in a metal washing tank 371, a wide stainless mesh anode 373 and a cathode 374 are inserted in a synthetic resin porous plate protrusion provided at the opposite position of the synthetic resin layer 372. The function of this embodiment apparatus is the same as the above apparatus of FIG. 15.

(Embodiment 8)

As shown in FIG. 17, the present embodiment is characterized in that synthetic resin porous plate protrusion parts are provided at opposite positions in a synthetic resin tank 381, and an anode 382 and a cathode are inserted therein. The function of the present embodiment apparatus is the same as the above apparatus of FIG. 15.

(Embodiment 9)

Using the above apparatus of FIG. 13, by adding a very small amount of table salt of less than 1% in concentration in water to increase the conductivity of water for improving the sterilization effect. The test result is shown in Table 4 below.

TABLE 4

| Time lapse after voltage application (min) | 1 | 2 | 4 |
|---|---|---|---|
| Number of general bacteria detected (pc/ml) | 120 | 15 | 0 |

(Embodiment 10)

Figure 18:
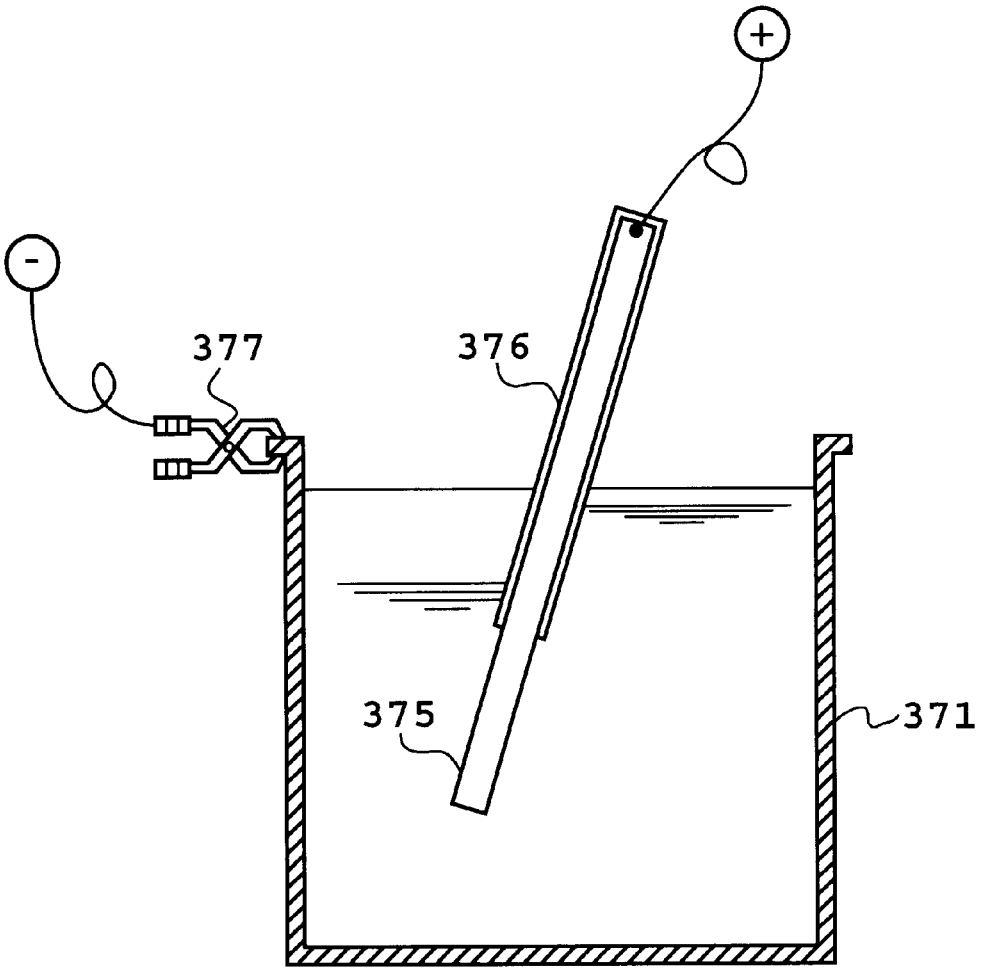
FIG. 18 is a yet further construction diagram of apparatus when the present invention is applied to a washing tank for foods such as vegetables.

The above-described apparatus are further simplified to construct an apparatus as shown in FIG. 18.

Water filled in the stainless steel washing tank 371 is agitated with a stainless steel agitator rod-formed anode 375. In the figure, numeral 376 indicates an insulating resin lining of the anode 375, 377 is a clamp-formed cathode used by mounting to the washing tank 371. As shown, the anode and the cathode are made detachable from the washing tank 371, so that the electrodes can provide corrosion protection and sterilization actions to existing apparatus without any specific improvement. Even a mild agitation is sufficient for improving the sterilization effect. The test result is shown in Table 5 below.

TABLE 5

| Time lapse after voltage application (min) | 1 | 3 | 6 |
|---|---|---|---|
| Number of general bacteria detected (pc/ml) | 350 | 30 | 0 |

(Embodiment 11)

In the above-described protection apparatus directed to a water pipe or washing tank as a metal structure, normally application of voltage uses DC current. However, as a result of operation for an extended period of time, on the surface of the platinum-coated metal electrode at the cathode side, an electrocoating film comprising calcium carbonate or magnesium hydroxide is formed and grows. As a result, electrical resistance of applied current for corrosion protection and sterilization is increased, current by initial stable low voltage is reduced, and protection effect and sterilization force are deteriorated. In a test conducted in a bathtub, a sliminess occurs on the inside surface.

To prevent this, when polarity of the anode and the cathode is reversed, it has been found that the electrode surface of the anode side becomes acidic, a film comprising calcium carbonate and calcium hydroxide is dissolved, as a result, both the corrosion protection action and the sterilization action are resumed.

Then, the reversing technique is carried out in the following two ways.

(i) a decreasing tendency of current value is detected, positive and negative sides of DC are reversed, and (ii) positive and negative sides are reversed at every predetermined time.

Figure 19:
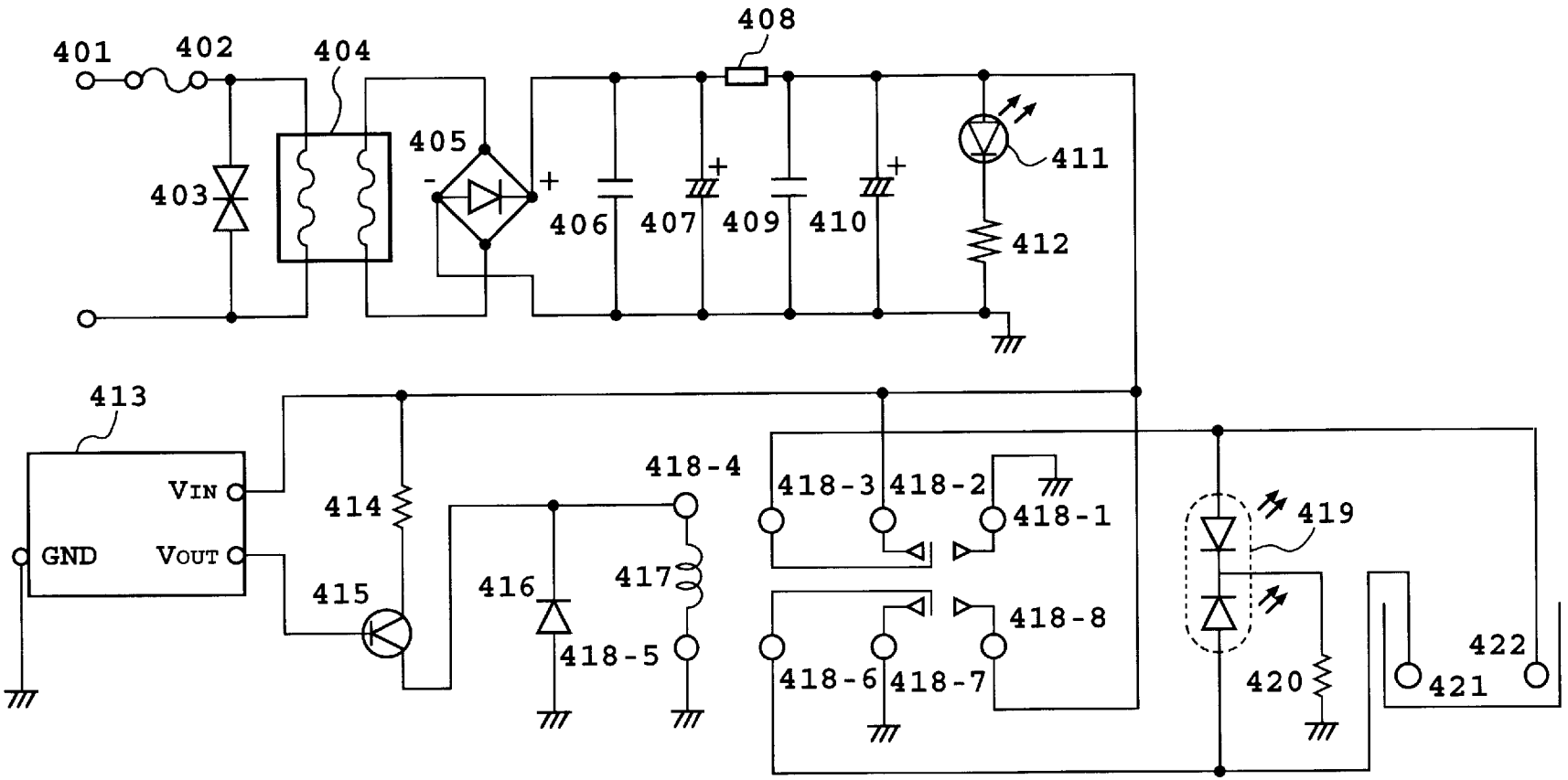
FIG. 19 is a diagram showing a construction of a voltage application control circuit having a function for preventing the apparatus of the present invention from formation of a film on the electrode with passage of time and a reduction of voltage application efficiency.

As a further example of explanation, a circuit construction for performing the method (ii) is shown in FIG. 19.

Output from an AC power supply 401 through a fuse 402 is stepped down by a transformer 404 to 15 to 40V. In the figure, 403 is a surge current absorption varistor. 405 is a rectifier circuit which coverts AC to DC. 406 and 407 are capacitors. 408 is a regulator, 409 and 410 are capacitors. 411 is a light emitting diode which displays input of electricity. 412 is a resistor for suppressing the current in the light emitting diode 411 to a necessary minimum. 413 is a timer circuit which by the function of a resistor 414 and a transistor 415 and a diode 416 flows a pulse current in a relay circuit 418-4, a coil 417, and a relay circuit 418-5. An ON/OFF time of the current is previously set to an appropriate value.

In current OFF, the relay circuits 418-3 and 418-2 are closed, and the relay circuits 418-6 and 418-7 are also closed, the relay circuits 418-1 and 418-8 are opened, an electrode 422 becomes an anode, and an electrode 421 becomes a cathode. Current flows in water of the tank and water pipe from the electrode 422 towards the electrode 421, thereby sterilizing microorganisms in water.

Further, in current ON, the relay circuits 418-3 and 418-1 are closed, and the relay circuits 418-6 and 418-8 are also closed, the relay circuits 418-2 and 418-7 are opened, the electrode 421 becomes an anode, and the electrode 422 becomes a cathode. Current flows in water of the tank and water pipe from the electrode 421 towards the electrode 422, thereby sterilizing microorganisms in water.

As described above, a system can be constructed in which a current necessary for corrosion protection and sterilization flows without resulting in formation of electrocoating on the cathode.

In FIG. 19, numeral 419 indicates a two-color light emitting diode, 420 is a resistor.

UTILIZABILITY IN INDUSTRY

A surface coating film of a metal structure often tends to have numerous invisible pinholes. Further, defects are generated in the coating film with the passage of time by sand dust or other environmental factors. Under such circumstances, when the humidity of the atmosphere exceeds 60%, a water film affecting the progress of corrosion is formed on the coating film surface, seal salt particles dissolve in the water film on the surface, and the water of the water film becomes an electrolytic water. The electrolytic water contacts with the metal surface through the pinholes or coating film defective parts to meet a rust generation condition. In this case, flowing a corrosion protection current through the electrolytic water film to suppress rust generation is a cathodic protection method. In this catholic protection method, the method according to the present invention, unlike the prior art method, increases the voltage applied to the anode according to an increase of required current amount, whereby a corrosion protection current can be flowed to an area away from the anode which has been considered to be impossible due to over-corrosion protection. In the present invention, corrosion protection current or voltage are controlled to optimum values according to a change in characteristic of specific medium (electrolytic water film) existing between the coating film of the metal structure to be protected and the anode. A maximum voltage of not causing over-corrosion protection in a coating film in the vicinity of the anode is maintained irrespective of an increase of the current, whereby increasing the electrical corrosion protectable area starting from the anode.

Further, on top of an undercoating of a general-purpose insulating paint, a conductive special paint is applied as a surface finishing paint, or a general-purpose insulating paint is applied as an underlayer, a thin plate-formed anode is stuck on the coated surface, an intermediate conductive paint is coated thereon, a paint of superior weather resistance is coated as a top layer, and further, by applying the cathodic protection method according to the present invention, thereby remarkably increasing the electrical corrosion protectable area starting from the anode. Therefore, by optimizing the combination of the types of the paints, voltage and current of the cathodic protection method of the present invention, a protection method for a metal structure of high cost-effectivity can be established.

As described above, with the present invention, electrical corrosion protection of all types, structures and shapes of metal structures can be performed efficiently and safely, when a large amount of water exist in the utilization environment, sterilization of the water can be achieved, and a healthy environment can be maintained.

What is claimed is:

1. A cathodic protection method for protecting a metal structure from corrosion, the method comprising:

mounting a main anode and a pilot anode on a coating film of a metal structure;

mounting a cathode to a metal base material of said metal structure;

applying a predetermined voltage from said pilot anode to said metal structure;

reading from a current value of said pilot anode a magnitude of required corrosion protection current for said metal structure to be corrosion protected, said magnitude of required corrosion protection current varying with variation of corrosion environment of said metal structure; and increasing or decreasing an application voltage of said main anode in accordance with said current value, whereby an optimum corrosion protection current is supplied according to corrosion environment of said metal structure.

2. The cathodic protection method as claimed in claim 1, wherein said pilot anode and said main anode are not only of one to one correspondence, but also one pilot anode corresponds to a plurality of main anodes.

3. The cathodic protection method as claimed in claim 1, wherein said pilot anode and said main anode are mounted to said metal structure to be corrosion protected through an insulating two-sided bonding material, whereby a water film is formed continuously from the surface of said metal structure to said respective anode, so that when a corrosion condition of said metal structure is met, a current optimum for corrosion protection flows between said anode and said cathode connected to metal base material of said metal structure.

4. The cathodic protection method for a metal structure as claimed in claim 1, wherein said metal structure is a vehicle, and a combination of a battery incorporated in said vehicle with electronic components for increasing voltage of said battery is used as a voltage application source.

5. A cathodic protection method for a metal structure comprising:

coating a metal structure to be corrosion protected by applying an underlayer of an ordinary insulating paint and applying a top layer of a conductive paint over the underlayer; and applying the cathodic protection method of claim 1 to the coated metal structure.

6. A cathodic protection method for a metal structure comprising:

coating a metal structure to be corrosion protected by applying an ordinary insulating paint as an underlayer, applying a conductive paint as an intermediate layer over the underlayer, and applying a weather resistant paint as a top layer over the intermediate layer; and applying the cathodic protection method of claim 1 to the coated metal structure.

7. A cathodic protection apparatus for protecting a metal structure having a coating film and a metal base material from corrosion, the apparatus comprising:

a main anode and a pilot anode adapted for mounting on said coating film of said metal structure;

a cathode adapted for connection to said metal base material of said metal structure; and current control means for applying a predetermined voltage from said pilot anode to said metal structure, for reading a magnitude of corrosion protection current of said metal structure to be corrosion protected from a current value of said pilot anode varying with variation of corrosion environment of said metal structure, and for increasing or decreasing application voltage of said main anode in accordance with said current value, whereby supplying an optimum corrosion protection current according to corrosion environment of said metal structure.

8. The cathodic protection apparatus as claimed in claim 7, wherein said pilot anode and said main anode are not only of one to one correspondence, but also one pilot anode corresponds to a plurality of main anodes.

9. The cathodic protection apparatus as claimed in claim 7, further comprising an insulating two-sided bonding material for mounting said pilot anode and said main anode on the surface of said metal structure, by mounting said respective anodes to said metal structure to be corrosion protected through said insulating two-sided bonding material, a water film is formed continuously from the surface of said metal structure to said respective anode, so that when a corrosion condition of said metal structure is met, a current optimum for corrosion protection flows between said anode and said cathode connected to a metal base material of said metal structure.

10. The cathodic protection apparatus as claimed in claim 7, wherein functions of said pilot anode and said main anode are integrally provided.

11. The cathodic protection apparatus as claimed in claim 7, wherein said current control means comprises transistors, diodes, operational amplifiers, and resistors.

12. A cathodic protected apparatus comprising:

a vehicle having a metal portion and a paint coating over at least some of the metal portion;

a combination of a battery incorporated in said vehicle with electronic components for increasing voltage of said battery for use as a voltage application source;

a main anode and a pilot anode mounting on said paint coating of said metal portion;

a cathode connected to said metal portion of said vehicle; and current control means for applying a predetermined voltage from said pilot anode to said metal portion, and for reading a magnitude of corrosion protection current of said metal portion to be corrosion protected from a current value of said pilot anode varying with variation of corrosion environment of said metal portion, and for increasing or decreasing application voltage of said main anode in accordance with said current value, whereby supplying an optimum corrosion protection current according to corrosion environment of said metal portion.

13. A cathodic protection method for a water pipe comprising:

mounting an anode to an inside surface of a water pipe;

mounting a cathode to a metal base material of said water pipe; and applying a voltage between said anode and said cathode, thereby flowing a predetermined electrical current in said water pipe.

14. The cathodic protection method as claimed in claim 13, further comprising reversing the polarity of said anode and said cathode after a period of time so as to dissolve a film formed on the surface of electrode over the period of time.

15. A cathodic protected apparatus comprising:

a water pipe having an inside surface and an outside surface, the water pipe being comprised of a metal base material;

an anode mounted on said inside surface of said water pipe;

a cathode mounted to said metal base material of said water pipe; and current control means for applying a voltage between said anode and said cathode, thereby flowing a predetermined electrical current in said water pipe.

16. The cathodic protected apparatus as claimed in claim 15, wherein said current control means has a function to reverse polarity of said anode and said cathode after a period of time so as to dissolve a film formed on the surface of electrode over the period of time.

17. A cathodic protection method for a metal tank comprising:

mounting an anode to an inside surface of said metal tank;

mounting a cathode to a metal base material of said metal tank; and applying a voltage between said anode and said cathode, thereby flowing a predetermined electrical current in said metal tank.

18. The cathodic protection method as claimed in claim 17, further comprising reversing the polarity of said anode and said cathode after a period of time so as to dissolve a film formed on the surface of electrode over the period of time.

19. A cathodic protected apparatus comprising:

a metal tank having an inside surface and an outside surface, the metal tank being comprised of a metal base material;

an anode mounted on said inside surface of said metal tank;

a cathode mounted to the metal base material of said metal tank; and current control means for applying a voltage between said anode and said cathode, thereby flowing a predetermined electrical current in said metal tank.

20. The cathodic protected apparatus as claimed in claim 19, wherein said current control means has a function to reverse polarity of said anode and said cathode after a period of time so as to dissolve a film formed on the surface of electrode over the period of time.

* * * * *